United States Patent [19]

Carlson

[11] 4,316,077

[45] Feb. 16, 1982

[54] ELASTIC HAIR DRYER HAVING SELECTIVELY VARIABLE AIR OUTPUT TEMPERATURE

[75] Inventor: Richard H. Carlson, Cumberland, R.I.

[73] Assignee: Texas Instruments Incorporated, Dallas, Tex.

[21] Appl. No.: 645,861

[22] Filed: Dec. 31, 1975

[51] Int. Cl.[3] ..... A45D 20/10; F24H 3/04; H05B 3/12

[52] U.S. Cl. ..... 219/370; 34/97; 165/96; 165/103; 165/122; 219/367; 219/374; 219/375; 219/381; 219/505

[58] Field of Search ..... 219/366-370, 219/374-376, 381-382, 504, 505; 165/86, 103, 96, 122; 34/96-101, 243 R

[56] References Cited

U.S. PATENT DOCUMENTS

| | | | |
|---|---|---|---|
| 1,626,400 | 4/1927 | Frank | 219/375 UX |
| 1,707,554 | 4/1929 | Hendry | 34/99 X |
| 2,147,283 | 2/1939 | Covell | 165/96 X |
| 3,305,665 | 2/1967 | Laing | 165/122 X |
| 3,674,980 | 7/1972 | Cox | 165/103 X |
| 3,927,300 | 12/1975 | Wada | 219/374 |

FOREIGN PATENT DOCUMENTS

| | | | |
|---|---|---|---|
| 313229 | 5/1956 | Switzerland | 219/381 |

*Primary Examiner*—A. Bartis

*Attorney, Agent, or Firm*—James P. McAndrews; John A. Haug; Melvin Sharp

[57] ABSTRACT

A hair dryer for use in personal beauty care incorporates a blower for moving a stream of air through a dryer housing onto the hair. A self-regulating, disc-shaped, electrical resistance heater body formed of a ceramic material of positive temperature coefficient of resistivity (PTC) and having a multiplicity of air flow passages extending between the opposite faces thereof is arranged the housing for heating the air stream. The heater body is mounted for rotational movement between a first position wherein the passages are parallel to the air flow direction so that substantially all of the air stream is directed through the passages and a second position wherein the passages are oblique to the air flow direction so that a substantial part of the air stream passes around the heater body without passing through the passages, whereby the temperature of the heated air directed onto the hair can be selectively varied by rotating the heater body to adjust the proportion of the air stream which is allowed to flow through the heater body passages. The heater body may be provided with baffles to maintain the air flow constant while the air temperature is varied by rotation of the heater body.

2 Claims, 9 Drawing Figures

ELASTIC HAIR DRYER HAVING SELECTIVELY VARIABLE AIR OUTPUT TEMPERATURE

BACKGROUND OF THE INVENTION

In a conventional hair dryer, a blower moves air through the dryer onto the hair and an electrical resistance heater is commonly positioned within the dryer to heat the air. In the conventional dryer, however, it has been difficult and expensive to provide a sufficiently large volume of air and to provide adequate capacity for heating such a large volume of air while also assuring that the dryer is safe to operate. That is, if the heater of the conventional dryer were provided with the desired large heating capacity, there would be a significant risk that, if the air intake to the dryer were to be inadvertently blocked or if air supply to the dryer were otherwise cut-off, the large heater could be subjected to catastrophic overheating. As a result, conventional hair dryers intended for the lower price segment of the beauty care market have commonly been provided with somewhat limited air volume and heating capacities.

It had been known that a highly efficient fluid heater could be formed from a body of electrical resistance material having a plurality of fluid passages extending through the body, the heater material having a positive temperature coefficient of resistivity and being adapted to display a sharp, anomalous increase in resistivity when self-heated to a selected temperature by directing electrical current through the body. It had also been known that, if utilized in a hair dryer or the like, such an electrical resistance heater would be self-regulating to eliminate the risk of overheating. That is, when such a heater is electrically energized while a stream of air or other fluid is directed through the heater passages by a blower or the like, heat output from the heater is high and excellent heating efficiency is obtained while the heater remains below the anomaly temperature at which its resistivity sharply increases. The cooling effect of the air moving through the heater passages also tends to maintain the heater in this high efficiency heating mode below its anomaly temperature. On the other hand, if the volume of air directed through the heater passages is reduced or cut-off so that the heater temperature tends to increase to its anomaly temperature, the heater resistivity sharply increases to reduce heater current, to stabilize the heater temperature, and to prevent overheating of the heater material. When operating in this high resistivity mode, the heat output and energy consumption of the heater are sharply reduced. However, when such a multi-passaged heater of positive temperature coefficient of resistivity is considered for use in a hair dryer or the like, it is found that it is difficult to vary the air output temperature of the dryer. It had been found to be particularly difficult to vary the temperature of the stream of air provided by the dryer without also undesirably varying the volume of heated air furnished by the dryer.

It is an object of this invention to provide a novel and improved fluid heater such as a hair dryer; to provide such a hair dryer system which is easily adjusted to regulate the temperature of air or other fluid heated by the system; to provide such a dryer which is highly efficient, which has a high air heating capacity, and which is safe to operate; and to provide such a dryer which is of simple, rugged and inexpensive construction.

Briefly described, the novel and improved hair dryer of this invention comprises a housing which defines an air path through the housing between an air intake and an air outlet. A blower of other comparable means is mounted on the housing for moving a stream of air along the air path and for directing the stream of air from the dryer through the air outlet. The dryer also includes a self-regulating electrical resistance heater formed from a body of ceramic resistance material having a plurality of fluid passages extending through the body. The resistance heater is formed from a material which has a positive temperature coefficient of electrical resistivity and which is adapted to display a sharp, anomalous increase in resistivity when the heater is self-heated to a selected temperature by directing electrical current through the heater material. The heater is mounted within the noted air path for heating air which is moved through the path by the blower means. In accordance with this invention, means are provided for adjusting the heat-transfer relationship between the heater body and the stream of air moving through the noted air path, thereby to vary the degree of heat-transfer between the body and the air to regulate the temperature of the air furnished by the dryer.

In one preferred construction, the heater body has a disc configuration and has its fluid passages extending in side-by-side relation between the broad flat surfaces of the heater disc. In this construction, the adjusting means preferably comprises means mounting the heater body for rotational movement between a first position having the heater passages extending parallel to the longitudinal axis of the air path so that substantially all air moving along the path is directed through the heater passages and a second position having the heater passages disposed oblique or perpendicular to the air path axis so that a substantial part of the air moving in the path passes around the heater without passing through the heater body passages. Air heated by being passed through the heater passages is then commingled with air passed around the heater to determine the temperature of the air stream furnished by the dryer. In this arrangement, when the heater body is moved from its first position toward its second position, the temperature of the air directed from the air outlet of the dryer is adjusted from an initial high air temperature to a relatively much lower air temperature.

In another preferred construction, the heater body has a disc-like ring configuration having a central opening of substantial size and having the heater body passages extending between opposite broad, flat disc surfaces of the heater ring. In this construction, the adjusting means preferably comprises a baffle disc rotatably mounted within the opening in the heater ring for movement between a first position perpendicular to the axis of the air path where the baffle blocks the central opening in the heater ring and directs substantially all of the air moving in the path through the heater passages and a second position extending parallel to the path axis where the baffle permits a substantial portion of the air moving in the air path to pass through the central opening in the heater ring without passing through the other passages of the heater body. In this arrangement, when the baffle is moved from its first position toward its second position, the temperature of the air directed from the dryer outlet is also adjusted from a high initial air temperature to a relatively much lower air temperature.

Other objects, advantages and details of the novel and improved fluid heater of this invention appear in the following detailed description of preferred embodiments of the invention, the detailed description referring to the drawings in which.

Figure 1:
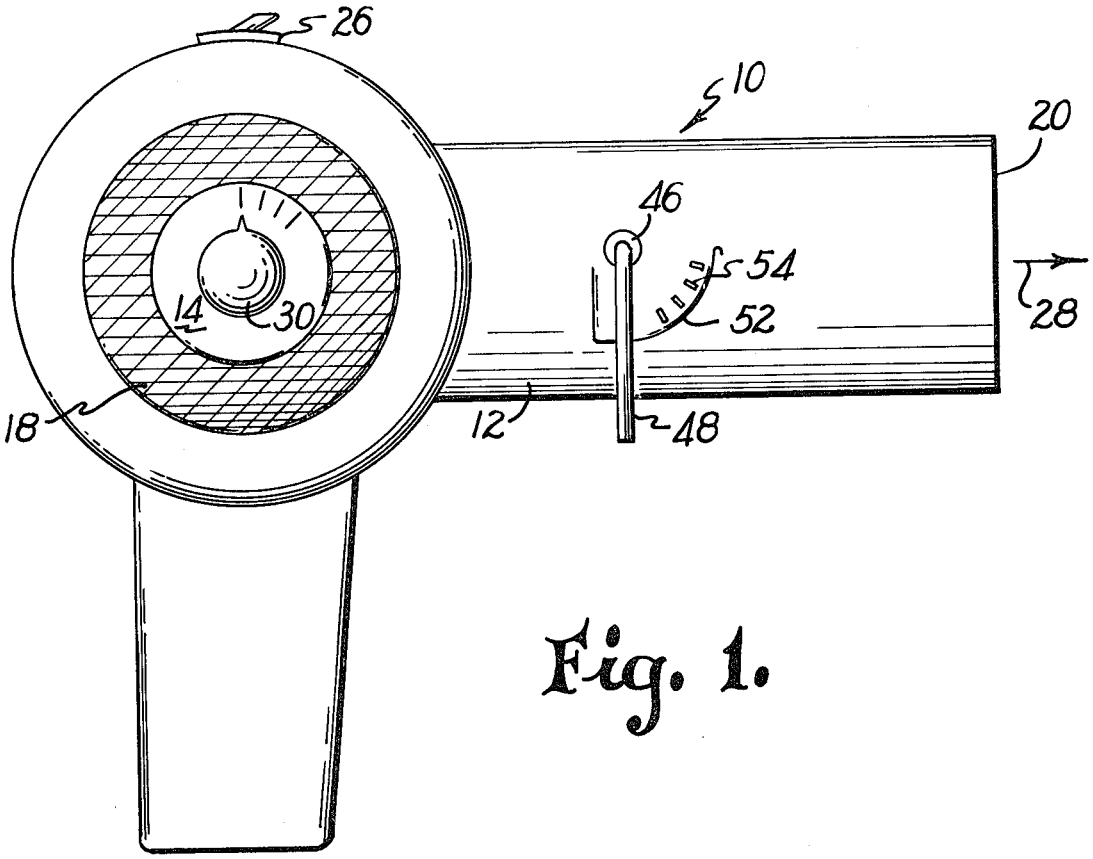
FIG. 1 is a side elevation view of the hair dryer provided by this invention.

Referring to the drawing, 10 in FIGS. 1–4 indicates a preferred embodiment of the novel and improved hair dryer of this invention which is shown to include a housing 12 having an air blower 14 mounted at one end of the housing, the housing defining an air path 16 extending through the dryer between an air intake opening 18 at one end of the dryer and an air outlet opening 20 at the opposite end of the dryer. The housing 12 is preferably formed of a heat-resistant, thermosetting or thermoplastic plastic material or the like and preferably encloses an electrically operable air blower 14 of the type conventionally used in hair dryers. As the air blower 14 is conventional, it is not further described herein and it will be understood that the blower includes electrical circuit means diagrammatically illustrated by the leads 22 and 24 in FIG. 2 for electrically connecting an electrical motor in the blower to a suitable power source such as a home wall receptacle for selectively energizing the blower on closing of the switch 26 to draw air in through the intake opening 18, to move a stream of air through the air path 16, and to direct the stream of air from the outlet opening 20 of the dryer onto the hair as is diagrammatically indicated by the arrow 28 in FIGS. 1 and 2. If desired, the air blower is adapted by the use of any conventional means, as is diagrammatically indicated by the control knob 30, to selectively vary the volume or flow rate of the stream of air which is directed along the air path 16 to be directed onto the hair.

Figure 3:
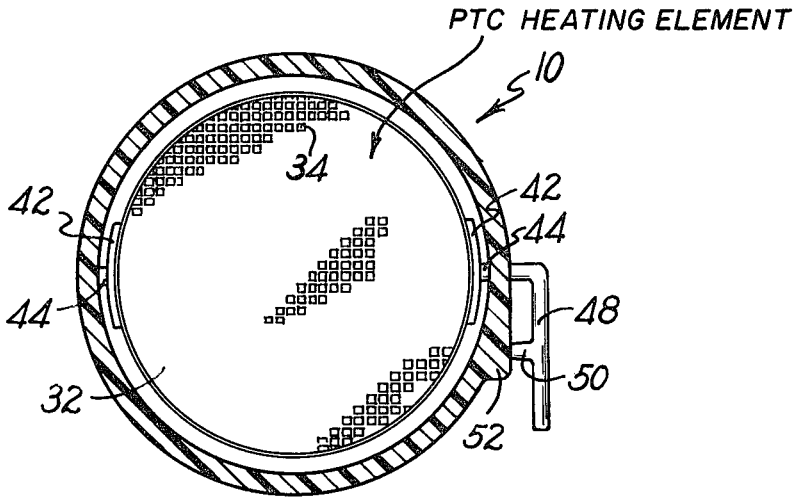
FIG. 3 is a section view along line 3—3 of FIG. 2.

In accordance with this invention, a self-regulating electrical resistance heater 32 is formed from a body of electrical resistance material having a multiplicity of fluid passages 34 extending through the body as shown in FIG. 3, the heater material having a positive temperature coefficient of resistivity and being adapted to display a sharp, anomalous increase in resistivity when the heater material is heated to a selected anomaly temperature by directing electrical current through the heater body. The heater body is mounted within the air path 16 to be in heat-transfer relationship to a stream of air moving through the air path; means are provided for directing electrical current through the heater body; and means are provided for adjusting the heat-transfer relationship between the heater body and a stream of air moving along the air path 16.

Figure 2:
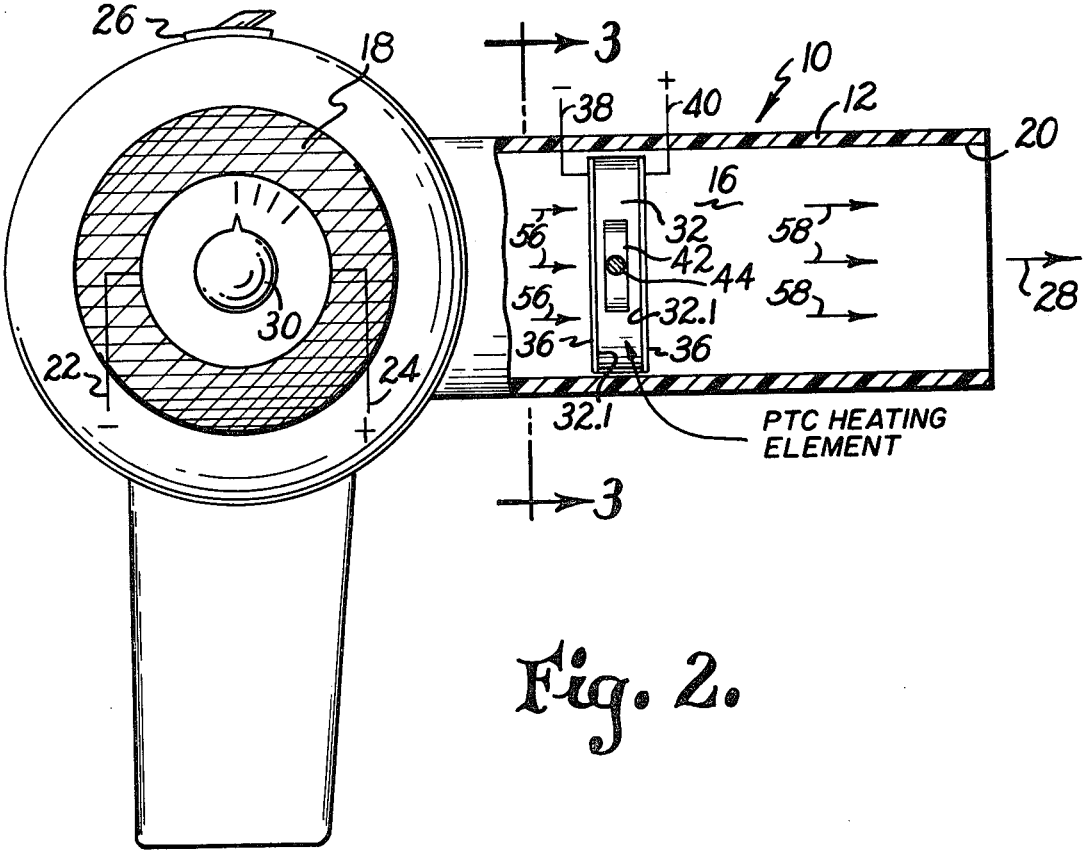
FIG. 2 is a view similar to FIG. 1 partly cut away to illustrate the heater of the dryer in a first operating position.

Preferably, the heater body 32 is formed from a semiconducting ceramic material such as a lanthanum-doped barium titanate material or the like, the body preferably having a disc-like configuration as illustrated in FIGS. 2 and 3 and having a multiplicity of passages 34 extending in side-by-side relation to each other through the body between opposite broad flat disc surfaces 32.1 of the body. Typically, for example, the heater body is formed from a lanthanum doped barium lead titanate ceramic resistance material having an empirical formula of $Ba_{0.837}Pb_{0.160}La_{0.003}TiO_3$ and having a room temperature resistivity of 100 ohm-centimeters, such a material having a positive temperature coefficient of resistivity and being adapted to display a sharply increased resistivity on the order of 10,000 ohm-centimeters when heated to about 220° C. through its nominal anomaly or Curie temperature of about 200° C. Typically, the heater body 32 has a diameter of about 1.5 inches and has a thickness of about 0.350 inches and each of the passages 34 is of square cross-section of 0.050 inches per side, the passages being separated from each other by walls of equal thickness of about 0.012 inches. Preferably also, a layer of metal 36 is secured to each of the opposite sides of the heater body 32 by dip or spray coating with molten metal or in other conventional manner to serve as electrical contacts for the resistor material of the heater body while leaving the ends of the passages 34 open.

Figure 4:
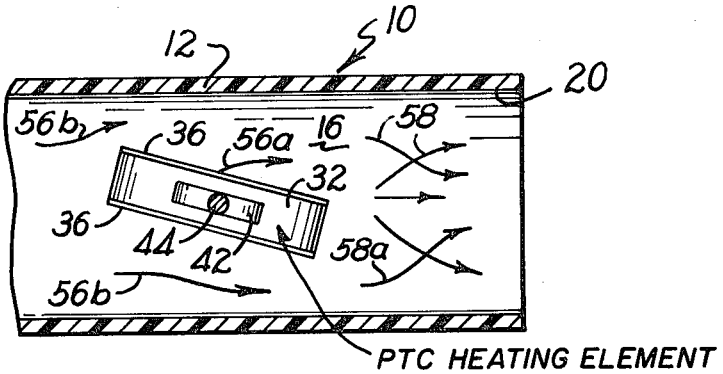
FIG. 4 is a partial view similar to FIG. 2 illustrating the heater in a second operating position.

Preferably also, the heater body is mounted within the air path 16 for rotational movement between a first position shown in FIGS. 2 and 3 where the heater body passages 34 extend in parallel relation to the longitudinal axis of the air path 16 and a second position shown in FIG. 4 where the heater body passages 34 are obliquely disposed, or perpendicularly disposed, relative to the axis of the air path 16. As illustrated in FIGS. 2 and 3, the heater body is preferably proportioned to extend over the full width of the air path 16 when in the noted first position, and any conventional electrical circuit means such as flexible braids or the like are electrically connected to the heater contacts 36 as is diagrammatically illustrated by the leads 38 and 40 in FIG. 2 for electrically connecting the heater body 32 to a suitable power source for energizing the heater 32 on closing of the switch 26 while permitting rotational movement of the heater body in the air path. Typically, also, straps 42 are soldered or otherwise secured to the heater body and are provided with shaft portions 44 rotatably mounted in bushings 46 in the frame 12 (see FIG. 1) for rotatably mounting the heater in the air path 16. A handle 48 secured to one shaft 44 is then frictionally engaged as at 50 with a boss 52, the boss being formed on housing and provided with spaced grooves 54 for permitting movement of the handle to move the heater to any selected rotational position within the air path 16.

Figure 5A:
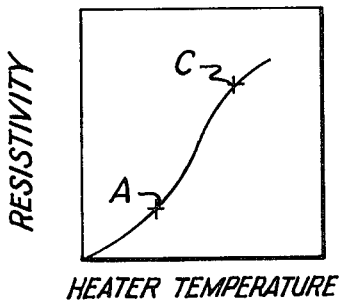
FIGS. 5A and 5B are graphs illustrating operating characteristics of the heater of FIGS. 1–4.
Figure 5B:
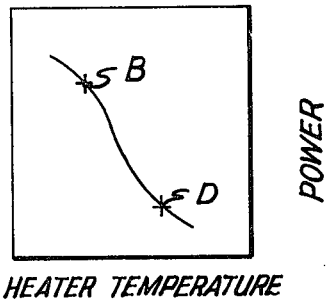

In operation of the dryer 10 as above-described, closing of the switch 26 is effective to energize the blower 14 so that ambient air is drawn in through the intake 18 and so that a stream of air at room temperature is directed toward the heater 32 as indicated by arrows 56 in FIG. 2. The switch closing also energizes the heater. When the heater is disposed in the position shown in FIG. 2, substantially all of this stream of room temperature air is directed through the heater passages 34 in excellent heat-transfer relationship to the heater body so that heat is rapidly withdrawn from the heater by the air, the heated air then being directed from the dryer outlet as indicated by the arrows 58 in FIG. 2. In this arrangement, the heater functions in a highly efficient manner to heat a stream of air having a substantial volume flow rate and, in accordance with this invention, the blower 14 is preferably adapted to provide a stream of air at a sufficient volume flow rate, typically about 30 cubic feet per minute, so that the heater temperature tends to increase to only a limited extent, whereby the resistivity of the heater body remains relatively low as indicated at point A in FIG. 5A while the power utilization of the heater and the heat transfer to the air is high as indicated at point B in FIG. 5B. Typically, the heater is adapted to heat a stream of air having the typical flow rate noted above to a relatively high air temperature on the order of 65° C. when the heater is in the position shown in FIG. 2, the heater utilizing about 450 watts of power at this temperature.

Alternately, when the handle 48 is moved to rotate the heater 32 to the position shown in FIG. 4, only part of the stream of room temperature air is directed through the heater passages in highly efficient heat-transfer relation to the heater body as indicated by the arrow 56*a* in FIG. 4 whereas a substantial proportion of the stream of room temperature air is permitted to pass around the heater in relatively poorer heat-transfer relation, or out of effective heat-transfer relation, to the heater body as indicated by arrows 56*b* in FIG. 4. As will be understood, the heated and relatively unheated portions of the stream of air indicated by the arrows 56*a* and 56*b* are then commingled downstream in the air path 16 as indicated by the arrows 58*a* in FIG. 4 and accordingly the air directed from the dryer outlet has a relatively lower effective air temperature. In this way, movement of the handle 48 to rotate the heater between the positions shown, or to any location between these positions, is effective to adjustably vary the air output temperature of the dryer in a desirable manner. It will also be noted that this air output temperature adjustment is adapted to be accomplished without substantial change in the volume of air directed from the dryer outlet. Accordingly, the dryer 10 as above-described is adapted to accomplish major objectives of this invention.

In this regard, it will be understood that, where the portion 56*a* of the stream of air passed in highly efficient heat-transfer relation to the heater body through the heater passages is reduced, the heater temperature tends to increase and to stabilize at a somewhat higher temperature, thereby causing an increase in heater resistivity, a reduction in heater current, and a reduction in power utilization and heat output by the heater. Further, where the portion of the stream of air passed in efficient heat-transfer relation to the heater is sufficiently small so that the heater temperature increases to its anomaly temperature, the heater resistivity sharply increases as shown at point C in FIG. 5A, the heater temperature stabilizes at a selected maximum temperature, and heat output and power consumption by the heater is sharply reduced as indicated at point D in FIG. 5B. Thus, the dryer is adapted to provide a relatively very low air output temperature where desired and, even if the air intake to the dryer should be inadvertently blocked, there is no risk that the heater will be subjected to excessive overheating.

Figure 6:
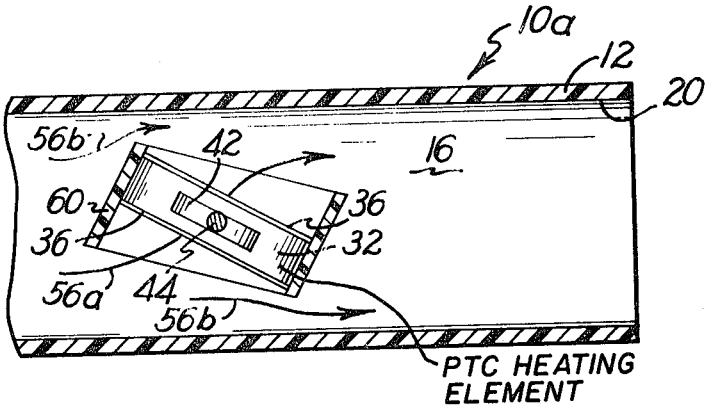
FIGS. 6, 7 and 8 are views similar to FIGS. 2 and 4 illustrating alternate embodiments of the hair dryer of this invention.

Another alternate embodiment of this invention is illustrated in FIG. 6. In this regard, it has been noted above that where the heater 32 described with reference to FIGS. 1–5 is moved between the position shown in FIGS. 2 and 4, the temperature of the air output from the dryer 10 is adapted to be varied without substantial variation to the volume flow rate of output air provided by the dryer. This maintenance of a more of less constant flow rate is dependent on the relative size of heater, the heater passages, and the air path 16. However, where the total cross-sectional area of the heater body passages 34 is substantially smaller than the cross-sectional area of the air path 16 and where the heater body thickness is also relatively small, movement of the heater 32 to the position shown in FIG. 4 may result in less restriction to air flow in the air path 16 so that some variation in the volume of air output from the dryer may occur. Accordingly, in the embodiment 10*a* of this invention illustrated in FIG. 6, wherein components of the dryer 10*a* corresponding to those illustrated in FIGS. 1–5 are identified by the same reference numerals, baffle means 60 are mounted on the heater 32, the baffle means being proportioned relative to the cross-sectional areas of the body passages 34 and the air path 16 so that air flow past the heater location is maintained substantially constant during rotation of the heater to adjust air output temperature. Preferably for example, the baffle means 60 comprises a generally cylindrical thermoplastic tube having obliquely cut ends fitted over the heater 32. In this arrangement, the baffle 60 has little effect on air flow in the path 16 when the heater passages 34 are parallel to the air path axis but, as the heater is rotated tending to reduce the restriction of air flow in the passage by permitting air to flow around the heater as indicated by the arrows 56*a* and 56*b* in FIG. 6, the baffle is moved with the heater to progressively restrict air flow and to counteract the reduction in air flow restriction caused by heater rotation. In this way air flow furnished by the dryer 10*e* is maintained at a constant level while the air temperature of the dryer output is varied by the heater rotation.

Figure 7:
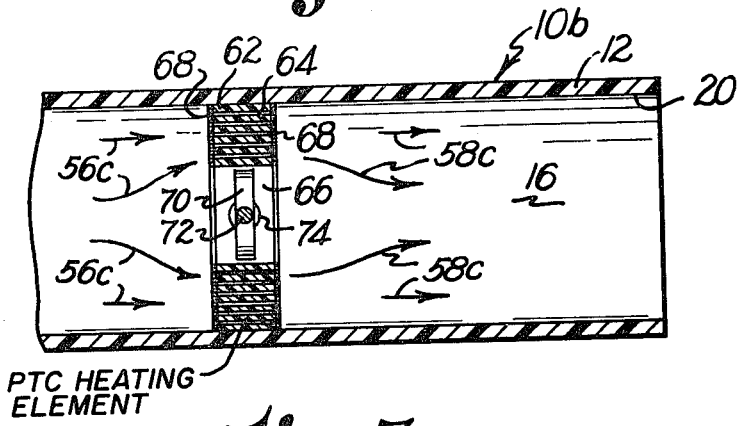
Figure 8:
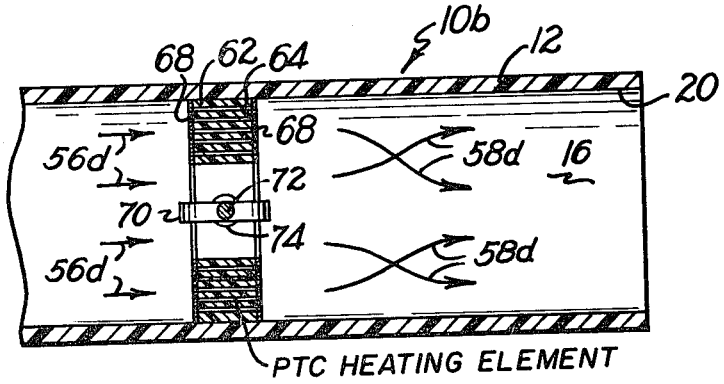

In another preferred embodiment of the hair dryer of this invention illustrated at 10*b* in FIGS. 7 and 8, the heater 32 previously described is replaced by a ring-shaped disc-like heater body 62 having a multiplicity of fluid passages 64 extending in side-by-side relation to each other between opposite broad disc surfaces 62.1 of the heater ring and having a relatively large central opening 66 formed in the ring. In this embodiment of the invention, the heater 62 is provided with metal contact layers 68 secured on opposite sides of the heater ring while leaving the passages 64 and the opening 66 fully open and is fixedly mounted within the air path 16 of the dryer with the heater passages 64 and opening 66 aligned parallel to the path axis. In accordance with this invention, a disc-like baffle 70 is mounted within the heater opening 66 in any conventional manner for permitting rotation of the baffle between a first position shown in FIG. 7 where the baffle extends perpendicular to the air path axis and effectively blocks the central opening in the heater and a second position illustrated in FIG. 8 where baffle extends parallel to the air path axis for substantially freeing the heater opening for the passage of air therethrough. In this arrangement, the blower of the heater 10*b* directs a stream of room temperature air toward the heater 62 so that, when the baffle 70 is in the position shown in FIG. 7, substantially all of this stream of heated air is directed through the heater body passages 64 as indicated by the arrows 56*c* in FIG. 7 in highly efficient heat-transfer relation to the heater body. In this way the stream of air passed through the heater passages 64 as indicated by the arrows 58*c* in FIG. 7 is heated to a relatively high temperature. However, when the baffle 70 is rotated to the position shown in FIG. 8, part of the stream of room temperature air indicated by the arrows 56*d* in FIG. 8 is permitted to pass through the heater opening 66 in relatively poorer heat-transfer relation, or out of effective heat-transfer relation, to the heater body, and only a part of the stream of air is passed through the heater body passages 64. The heater portions of the stream of air passed through the passages 64 and the relatively unheated portion of the stream of air passed through the opening 66 are then commingled downstream from the heater as illustrated by the arrows 58*d* in FIG. 8, thereby to provide the output air furnished by the dryer 10*c* with a relatively lower temperature. As will be understood, the baffle 70 is easily mounted for rotation within the opening 66 by providing the baffle with a supporting shaft 72 and by mounting the shaft in bushings 74 inside the heater body, one end (not shown) of the shaft extending through the heater and out of the dryer housing to permit rotation of the baffle from outside the housing.

It will be understood that, in the preferred embodiments of this invention as described above, the blower 14 is described as moving a stream of air along the air path 16 at a selected volume flow rate while the heat-transfer relationship between the stream of air and the noted heater is moved for varying air output temperature. However, such dryers are also adapted to be provided with blowers having variable capacities as previously described for permitting variation in the flow rate of the air output from the dryer where desired. Thus, as described with reference to FIGS. 1–5, the blower output can be varied by movement of the control knob 30 after operation of the dryer has been initiated to provide the desired air flow rate through the dryer. The heat-transfer relationship between the heater and the desired stream of air is then varied in the manner above described to provide the desired air temperature. In this way, the dryer of this invention permits variation of an output temperature with or without variation of air output volume as may be desired.

It should be understood that although preferred embodiments of the hair dryer have been described by way of illustrating this invention, the invention includes various modifications and equivalents of the described embodiments falling within the scope of the appended claims.

I claim:

1. A hair dryer comprising housing means defining an air path having an inlet portion and having an outlet portion shaped to commingle air directed along the path, means moving a stream of air along said path to be directed from said dryer through the outlet portion of the path, a heater body of electrical resistance material of positive temperature coefficient of resistivity adapted to be self-heated when electrical current is directed through the body and to display a sharp increase in electrical resistivity when heated to a selected temperature for limiting said self-heating, said body having a plurality of air flow passages extending through the body, means for directing electrical current through the body, and means mounting the body for movement between a first position in the path permitting a selected proportion of the stream of air moving in the path to pass in heat-transfer relation to the body through said body passages to withdraw heat from the body for heating said air and for tending to maintain the resistivity of the body material at a relatively low level to enhance heat output by the body and a second position permitting a relatively lesser proportion of the stream of air moving in the path to pass in heat-transfer relation to the body through the body passages and to commingle in the outlet portion of the path with other air moving along the path outside the body passages for regulating the temperature to which the air is heated while moving along the path and while assuring that any resulting reduction in heat-withdrawal from the body results in increased resistivity of the body material for avoiding overheating of the body, said housing means defining said air path with a portion thereof of selected cross-sectional area and said heater body having a disc-shape with broad opposite side surfaces and having said body passages extending through the body between said opposite surfaces, said body being mounted in said air path portion for movement between said first position wherein said broad surfaces extend normal to the longitudinal axis of the path so that substantially all of the stream of air moving in the air path portion passes in heat-transfer relation to the body through the body passages and said second position wherein said body surfaces extend obliquely relative to the longitudinal axis of the path permitting a relatively less proportion of the stream of air moving in the air path portion to pass in heat-transfer relation to the body through the body passages and permitting other air moving in the air path portion to pass around the heater body and to commingle with the air passed through the body passages.

2. A hair dryer as set forth in claim 1 having a baffle means mounted for movement with said heater body to maintain air flow restriction in said path at a substantially constant level during said movement of said heater body.

* * * * *